US005113668A

United States Patent [19]

Wachs, III et al.

[11] Patent Number: 5,113,668

[45] Date of Patent: * May 19, 1992

[54] REFRIGERATION SYSTEM WITH EVAPORATIVE SUBCOOLING

[75] Inventors: Fred B. Wachs, III, Lexington; Roy W. Abbott, Louisville, both of Ky.

[73] Assignee: Advanced Cooling Technology, Inc., Lexington, Ky.

[ * ] Notice: The portion of the term of this patent subsequent to Dec. 3, 2008 has been disclaimed.

[21] Appl. No.: 654,792

[22] Filed: Feb. 12, 1991

Related U.S. Application Data

[63] Continuation of Ser. No. 376,432, Jul. 7, 1989, Pat. No. 5,069,043.

[51] Int. Cl.[5] ..... F28D 5/00

[52] U.S. Cl. ..... 62/305; 62/506; 62/280; 62/311

[58] Field of Search ..... 62/305, 311, 184, 280, 62/506

[56] References Cited

U.S. PATENT DOCUMENTS

| | | | |
|---|---|---|---|
| 3,979,923 | 9/1976 | Jennings | 62/305 |
| 4,067,206 | 1/1978 | Smith | 62/280 |
| 4,631,927 | 12/1986 | Hashimoto | 62/280 |

*Primary Examiner*—Albert J. Makay

*Assistant Examiner*—John Sollecito

*Attorney, Agent, or Firm*—King & Schickli

[57] ABSTRACT

A refrigeration system including a compressor, condenser and evaporator utilizes an evaporative subcooler downstream of the condenser for subcooling the refrigerant for increased system efficiency. The strategic placement of the subcooler for cooling in the liquid zone allows the operating pressure and temperature of the refrigeration system to be reduced and the refrigerant in the system to provide the greatest cooling effect in the evaporator. As an additional feature, a counterflow heat exchanger is provided in the liquid zone adjacent the subcooler in order to provide additional subcooling and also provide for warming of the cooling water used for evaporative cooling. The subcooler can be readily used as a retrofit in an existing system and is particularly adapted for increasing efficiency in high capacity use situations, such as in the food industry. Preferably, condensate water is used for cooling in the evaporative subcooler, but tap water is used for makeup cooling water. The water is pumped by a cone pump and delivered by a slinger integral with the cone pump to the coils. An intercepter panel adjacent the coils provides a metered overflow of cooling water in order to provide dilution of any minerals from the makeup tap water in order to avoid build-up of mineral deposits.

9 Claims, 2 Drawing Sheets

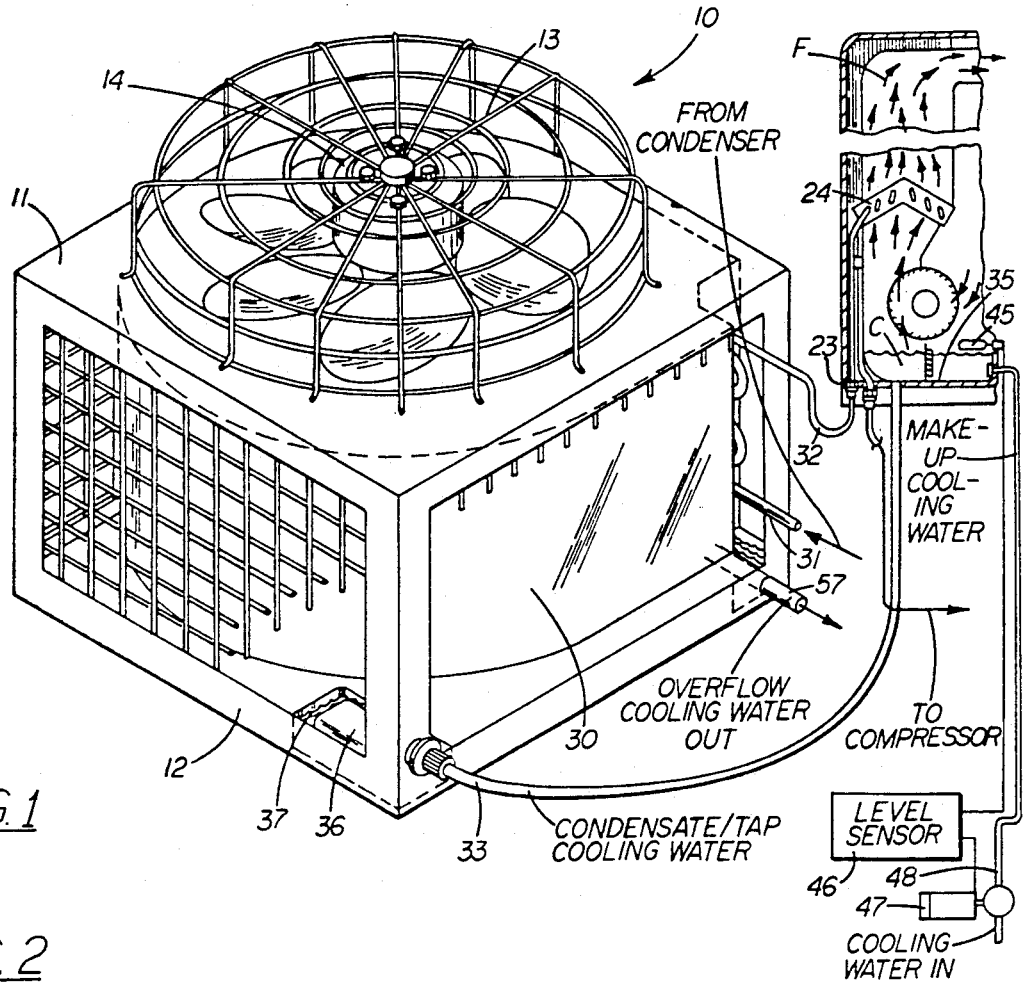
FIG. 1
FIG. 2
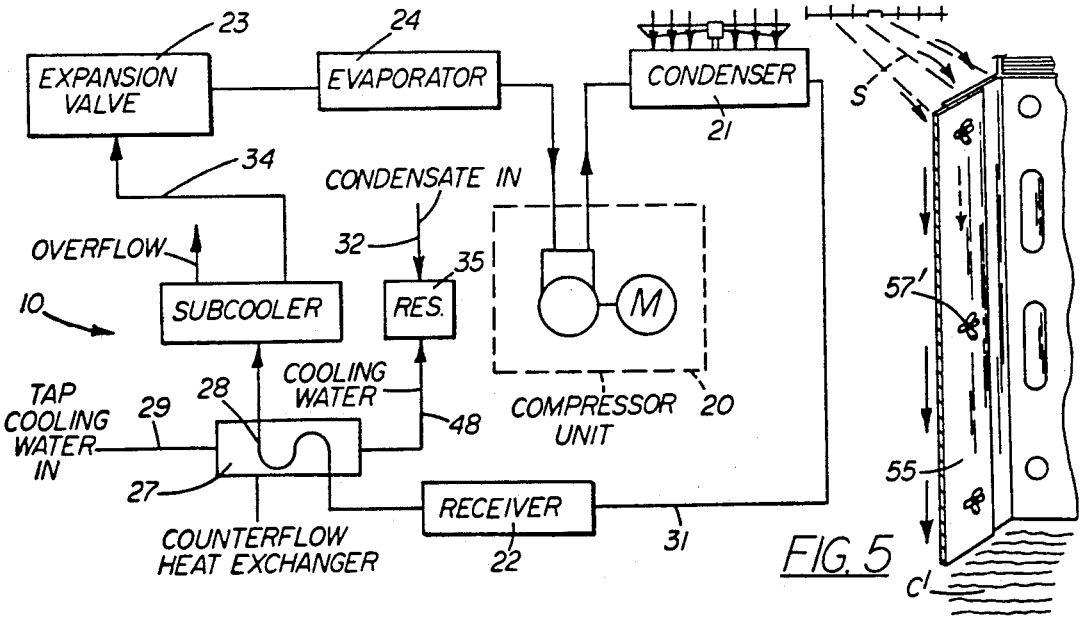
FIG. 5

REFRIGERATION SYSTEM WITH EVAPORATIVE SUBCOOLING

This application is a continuation of the U.S. patent application entitled REFRIGERATION SYSTEM WITH EVAPORATIVE SUBCOOLING, Ser. No. 376,432, filed Jul. 7, 1989, now U.S. Pat. No. 5,069,043.

BACKGROUND OF THE INVENTION

The present invention relates to refrigeration systems or the like, and more particularly, to a refrigeration system employing evaporative subcooling to provide for increased efficiency and metered overflow of cooling water to prevent mineral build-up on the cooling coils.

Evaporative heat exchangers are well known in the cooling art. Especially in desert areas where the humidity is low, evaporative coolers have long been used as a primary, or secondary cooling means. In essence, water is sprayed into a chamber or over a coil so that the surrounding ambient air or the fluid in the coil is cooled. The cooling is highly efficient since the latent heat of evaporation of the water droplets is substantially more effective to absorb heat than the surface cooling effect of water or air alone can be.

There has been at least one effort to apply an evaporative condenser or cooler to a refrigeration system, more specifically to an air conditioning system. This concept is set forth in the U.S. Pat. No. to Beasley et al. 4,404,814, issued Sep. 20, 1983. In this particular system, the evaporative cooler is used as a de-superheater for the very specific purpose of reducing the compressor discharge pressure and the refrigerant temperature entering the condenser. The de-superheater is energized only in the event that the compressor pressure/temperature exceeds an upper threshold level. In the Beasley arrangement, the temperature of the liquid refrigerant entering the condenser is reduced at the high end of the temperature scale. This arrangement unfortunately ignores the fact that reducing the temperature at the high end of the scale is not efficient since the ambient air passing over the condenser coils can do this job more effectively for a given amount of power input.

In addition to providing an approach of de-superheating, there have been some efforts in the prior art to use auxiliary cooling devices as subcoolers. In this effort for example, additional heat exchange coils are provided in the closed loop refrigeration system downstream of the condenser. This art includes attempts at providing subcooling units of the counterflow heat exchanger type as an add-on or retrofit for existing refrigeration systems or the like. A typical system utilizing a simple liquid cooling coil is shown in the U.S. Pat. No. to Jennings 3,177,929, issued Apr. 13, 1965. While these units have been around for years, it is generally accepted that they have not been successful because the increase in efficiency of the subcooling unit working alone does not justify the cost of the unit. It has been felt by many in the industry that if the efficiency of the subcooling unit could be improved, the cost would clearly be justified. However, prior to the present invention no such advance has been made.

Subcooling the liquid refrigerant on the downstream or liquid side of the condenser thus holds promise if the increase in efficiency is improved to make it economically feasible. The effect of this subcooling can be visualized on the standard pressure/enthalpy chart for the standard CFC refrigerant. The cooling capacity of the refrigerant is increased as represented by the increased area on the left side within the diagram lines of the chart. The saturated liquid refrigerant is cooled beyond the reference line on the left side providing an increase in efficiency.

Accordingly, additional effort is justified in seeking new ways of subcooling other than through a simple liquid/liquid counterflow heat exchanger. While such counterflow heat exchangers are useful, used alone they have simply proven not be of great enough efficiency to become a wide-spread commercial reality. It is thus appropriate to look for a new approach to subcooling in a refrigeration system using more efficient approaches, singularly or in combination.

SUMMARY OF THE INVENTION

Accordingly, it is a primary object of the present invention to provide a refrigeration system utilizing a novel approach for subcooling to greatly increase the efficiency of operation.

It is another related object to provide a refrigeration system with increased cooling capacity resulting from use of an evaporative subcooler for operation on liquid refrigerant connected between the condenser and the expansion valve/evaporator.

It is still another object of the present invention to provide a refrigeration system having a multi-stage subcooling arrangement utilizing an evaporative subcooler and a counterflow heat exchanger in tandem.

It is still another object of the present invention to provide an evaporative subcooler in a refrigeration system making the most efficient use of cooling water coming from condensate of the condenser supplemented by tap makeup water.

It is still another object of the present invention to provide an overflow dilution arrangement to assure against build-up of mineral deposits on the subcooler coil.

Additional objects, advantages and other novel features of the invention will be set forth in part in the description that follows and in part will become apparent to those skilled in the art upon examination of the following or may be learned with the practice of the invention. The objects and advantages of the invention may be realized and obtained by means of the instrumentalities and combinations particularly pointed out in the appended claims.

To achieve the foregoing and other objects, and in accordance with the purposes of the present invention as described herein, a refrigeration system is provided having an evaporative subcooler positioned along the liquid zone in the circuit. The compressor, condenser, expansion means and the evaporator of the refrigeration system are connected in series to provide cooling. In order to enhance the performance of the system in accordance with the present invention, the evaporative subcooler is preferably connected into the system between the condenser and expansion means. The subcooler further reduces the temperature of the refrigerant liquid that is condensed in the condenser. The result is a greater cooling effect of the liquid refrigerant in the evaporator providing the increased efficiency and capacity in extracting heat.

In order to provide additional subcooling, a counterflow heat exchanger receives tap cooling water and preferably further lowers the temperature of the refrigerant liquid. The warmed cooling water is then fed to the evaporative subcooler where it is sprayed onto the subcooler coils and by the release of latent heat of evaporation substantially reduces the temperature of the refrigerant liquid. This multi-stage or tandem subcooling provides maximum efficiency; however, the evaporative subcooler provides by far the greatest efficiency gain. In the typical application with 95° F. ambient temperature and 50% relative humidity, the evaporative subcooler reduces the liquid refrigerant temperature from approximately 130° F. to 80° F. assuming properly sized coils are matched to the basic refrigerant system and a full refrigerant charge. With this enhanced cooling in the liquid zone, the cooling capacity of the system is substantially increased. On the pressure/enthalpy chart, the area on the left side within the diagram lines is enlarged and the differential heat removal capacity represented by the distance across the diagram in the chart is increased by 10-20% in the typical installation.

Preferably, the condensate liquid from the evaporator is collected in a reservoir and means are provided for feeding this water to the subcooler. A combined pump/slinger means is employed in the subcooler for distributing the cooling water in a fine spray over the cooling coils of the subcooler.

In some installations, such as in a large supermarket, there may be sufficient condensate water to supply the entire needs of the subcooler. In this case, the subcooler operates most efficiently since the water is at a lower temperature and includes no minerals that might provide a build-up on the coils.

However, in most instances, additional makeup water is needed to supply the subcooler and allow it to operate at greatest efficiency. This makeup water must come from the tap water which normally includes minerals that may build up on the coils unless provision is made to alleviate this problem. In accordance with another aspect of the present invention, an intercepter panel is provided along an angular section of the coils of the subcooler for receiving and diverting a portion of the cooling water spray. An overflow reservior is positioned under the intercepter panel for receiving the water whereby a limited amount of cooling water is continuously discharged. With the discharged cooling water is the concentration of minerals that would otherwise be deposited on the cooling coils. With this overflow/mineral dilution arrangement, a longstanding problem concerning evaporative coolers is solved.

The preferred range for the ratio of the cooling coil surface in the evaporative subcooler to the surface area of the intercepter panel is in the range of 42:1 to 14:1. The actual preferred ratio is approximately 30:1. In order to further minimize the possibility of mineral deposits on the cooling coils, only the least amount of tap water needed to supplement the condensate water is used. This is regulated by a float valve in the supply reservoir which can be positioned in the drain pan of the evaporator.

A float valve also controls the reservoir for cooling water in the base of the evaporative subcooler. A cone pump/slinger generates the radial spray of cooling water around the cooling coils. The pump/slinger is driven by a standard fan and AC motor combination that provides the flow of ambient air across the coils for cooling.

Still other objects of the present invention will become apparent to those skilled in this art from the following description wherein there is shown and described a preferred embodiment of this invention, simply by way of illustration of one of the modes best suited to carry out the invention. As it will be realized, the invention is capable of other different embodiments and its several details are capable of modification in various, obvious aspects all without departing from the invention. Accordingly, the drawings and descriptions will be regarded as illustrative in nature and not as restrictive.

BRIEF DESCRIPTION OF THE DRAWINGS

The accompanying drawings incorporated in and forming a part of the specification, illustrates several aspects of the present invention, and together with the description serves to explain the principles of the invention. In the drawings:

FIG. 1 is a perspective view of the evaporative subcooler of the present invention coupled with a schematic diagram of a portion of the refrigeration system including the evaporator and the cooling water supply/control for the evaporative subcooler;

FIG. 2 is a schematic block diagram showing the full refrigeration system in block form;

FIG. 5 is a detailed perspective view of the intercepter panel for deflecting a metered portion of the cooling water to prevent mineral deposit build-up on the coils and taken along line 5—5 of FIG. 3.

Figure 3:
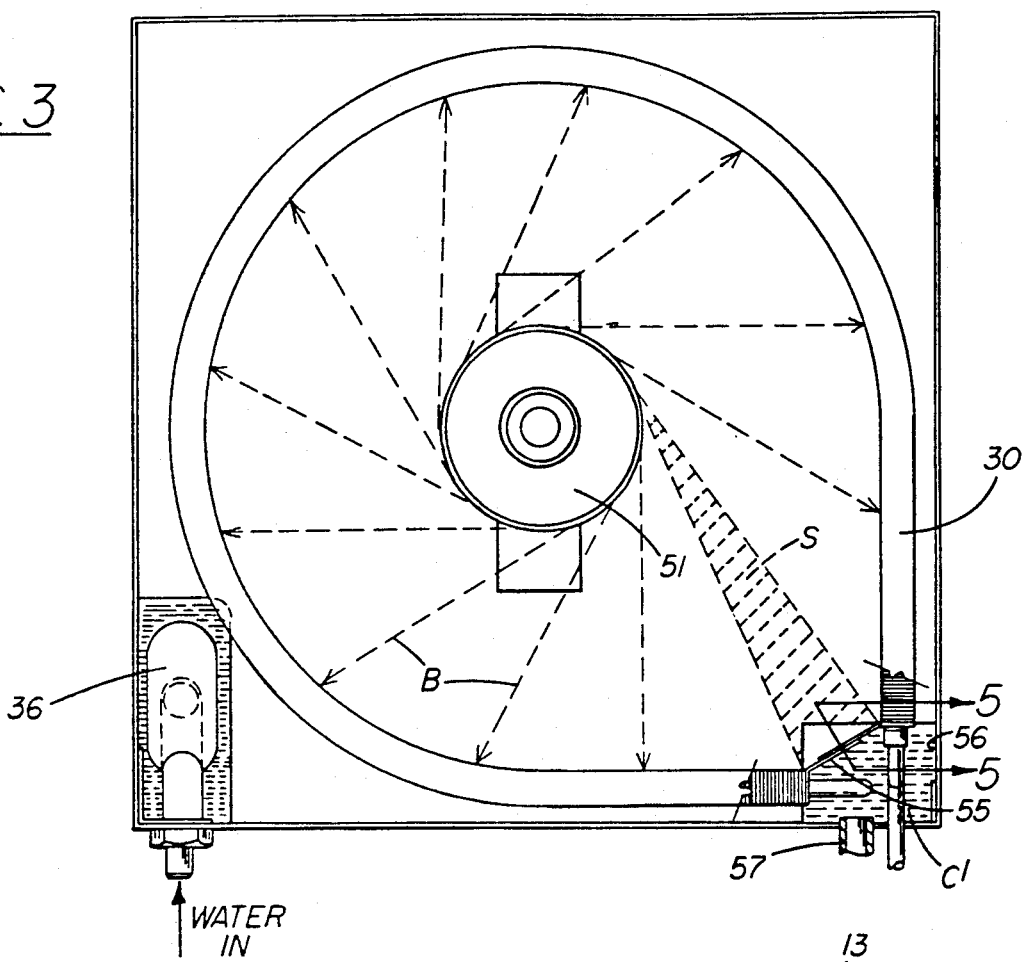
FIG. 3 is a top view of the evaporative subcooler showing the spray pattern of the cooling water.

Reference will now be made in detail to the present preferred embodiment of the invention, an example of which is illustrated in the accompanying drawing.

DETAILED DESCRIPTION OF THE INVENTION

With reference to FIG. 1 of the drawings, an evaporative subcooler 10 is illustrated for installation in a refrigeration system (see FIG. 2), such as used in the food industry to cool supermarket cases or the like. However, it is to be understood that the concepts can be advantageously applied to other uses where refrigeration is required including air conditioning units. Subcooler 10 comprises a housing 11 and a base 12. On top of the housing 11 is a protective grill 13 supporting a standard fan/motor 14. The fan is driven to draw ambient air into the top of the subcooler 10 and discharge the heated air along the four sides in a generally outward direction.

The evaporative subcooler 10 is either retrofitted or provided as an OEM component part of a standard closed loop refrigeration system including a compressor unit 20, a condenser 21, a receiver (accumulator) 22, an expansion valve 23 and an evaporator 24, all connected in series (see FIG. 2). The compressor 20 provides compressed refrigerant gas to the condenser 21; the liquid refrigerant being delivered to the expansion valve 23 and the evaporator 24 via the receiver 22. The outlet of the evaporator conducts the liquid refrigerant to the compressor, and in turn, the compressor is connected back to the inlet of the condenser to provide the high pressure refrigerant thereto.

The evaporative subcooler 10, which is the subject of the present invention, is advantageously connected between the condenser and the expansion valve 23 feeding the evaporator 24. In accordance with the invention, this is the ideal position for the evaporative subcooler 10 since heat is extracted from the refrigerant in the liquid zone after being initially cooled in the condenser 21 and having passed through the receiver 22. The evaporative subcooler operates more efficiently on the liquid in the system removing heat by release of the latent heat of evaporation.

Of significance, with our inventive system the condenser 21 is allowed to operate in its most efficient environment, that is in the region of the highest temperature in the loop; whereas, the evaporative subcooler 10 likewise operates in its most efficient environment, that is, in the lower temperature liquid refrigerant zone. The result is to provide a greater cooling effect of the refrigerant once it reaches the evaporator thereby increasing the refrigeration system efficiency. As indicated, utilization of the evaporative subcooler 10 operates to increase efficiency equally well in all refrigeration systems, such as a refrigerator or freezer for keeping foods or other commodities cold, space air conditioning units or other like systems.

In order to further improve the efficiency of the subcooling operation in the circuit of the present invention, it is contemplated that a counterflow liquid heat exchanger 27 can be inserted adjacent the subcooler 10 (preferably upstream). This heat exchanger 27 has a fluid chamber through which a coil 28 passes carrying the liquid refrigerant. The tap cooling water enters the heat exchanger chamber through line 29, extracts heat by liquid/liquid contact across the coil 28 and is then fed to the reservoir 35 for mixing with condensate from the line 32 via line 48. The cooling water mixture then enters the subcooler 10 for the main subcooling function.

Whereas the overall efficiency of the circuit is increased by the subcooler 10 by double digit figures, the heat exchanger 27 improves the efficiency by a lesser (single digit) amount. Advantageously however, by heating this portion of the cooling water before entering the subcooler 10, the water is more readily evaporated, thus releasing the latent heat of evaporation more readily.

With reference back to FIG. 1 and continuing to view FIG. 2, evaporative subcooler 10 can be seen to include cooling coils 30 with an inlet for refrigerant through line 31 from the condenser 21. The cooling coils 30 also include the outlet feed line 34 going to the expansion valve 23 and into the evaporator 24. Air is forced over the evaporator 24 by a squirrel cage fan with cooled air being forced from the evaporator 24, as shown by the flow arrows F.

Figure 4:
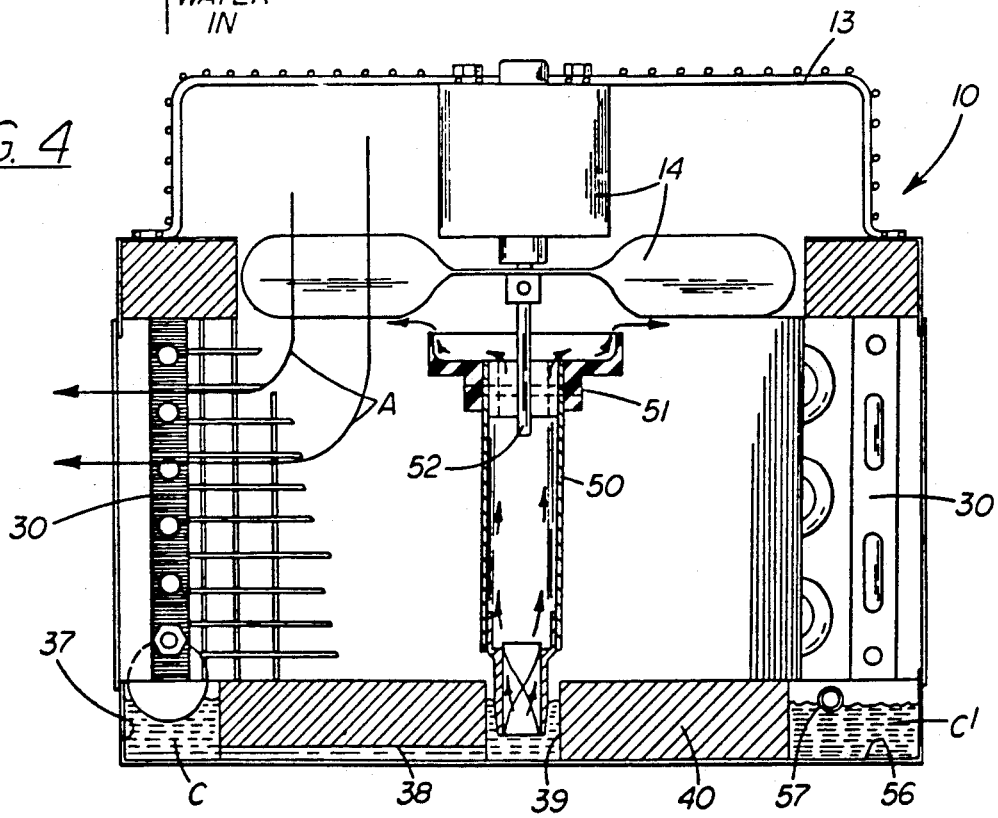
FIG. 4 is a cross sectional view taken along the center line of the evaporative subcooler and showing the combined cone pump and slinger.

A reservoir 35 is provided in the base of the evaporator 24 to collect the condensate water (see FIG. 1) from the atmosphere condensing on the chilled coil of the evaporator 24. Condensate C from the collection reservoir 35 is delivered by a cooling water drain line 33 to a point adjacent the base 12 of the evaporative subcooler 10. Any time the level of the feed to the evaporative subcooler 10 is threatened by the water level falling below a given level, float valve 36 opens to allow additional cooling water to fill feed reservoir 37 in the base 12 (see also FIG. 4). A feed channel 38 provides a delivery path for the cooling water to central holding cup 39. The base 12 preferably includes a styrofoam or other lightweight insert 40 forming reservoir 37, feed channel 38 and cup 39.

In most installations, the condensate coming from the evaporator 24 is not sufficient to supply the desired constant flow of water for the evaporative subcooler 10. For this reason, a tap water makeup system may be provided including a float 45 in the reservoir 35, providing a signal to an electric level sensor 46 for controlling a solenoid valve 47 along a tap cooling water line 48 (see FIGS. 1 and 2). Thus in a normal installation, the cooling water drain line 33 includes both condensate and tap water.

The use of the subcooler 10 by itself in the refrigeration circuit provides unexpectedly favorable results in increasing the efficiency of the refrigeration system. A 10-20% increase in the heat absorbing capacity of the evaporator 24 can be expected. The latent heat of evaporation of the cooling water that takes place as the water is sprayed over the coils 30 gives outstanding results in efficiency improvement. The same results obtained by use of the evaporative subcooler cannot be obtained by simply increasing the coil length in the condenser 21 since the heat transfer efficiency utilizing ambient air degrades rapidly as the liquid is formed in the final section of the condenser coils. Furthermore, utilizing evaporative cooling in the position of the circuit we propose reduces the liquid refrigerant to the wet bulb temperature and is considerably more efficient than use in the zone for de-superheating; that is, between the compressor 20 and the condenser 21. This is so since the most efficient use of the ambient air is for removal of heat from the high temperature refrigerant gas immediately upon entry into the condenser 21. At this point, the temperature differential is the greatest and when this temperature is lowered, as in the prior art Beasley patent mentioned above, less efficient downstream heat transfer takes place.

In the subcooler 10, the cooling water is actually sprayed against the coils in a very efficient manner. A combined cone pump/slinger 50 picks up the water from the holding cup 39 and slings the water radially outwardly from upper slinger collar 51 (see flow arrows in FIG. 4). The pump/slinger 50 is driven continuously directly from the shaft 52 of the fan/motor 14 so that a minimum amount of power is needed for providing the increase in cooling capacity of the refrigeration system.

Ambient air enters from the top through the grill and is deflected downwardly and outwardly, as shown by the flow arrows A. The droplets of water are surrounded by the cooling air and are broken into a fine mist by the turbulence as they are projected outwardly and into the fins of the coils 30. The hot coils cause a substantial amount of the moisture to evaporate thereby releasing the latent heat of evaporation, and a greater cooling effect than would be possible with a simple liquid/liquid heat transfer arrangement takes place. The water that does not evaporate trickles down the coils 30 and into the feed reservoir 37 formed by the cut-out sections of the insert 40. This water is then recirculated by traveling along the feed channel 38 and into the central holding cup 39 where it is again picked up by the pump/slinger 50. As indicated above, as additional water is needed to replace the evaporated water, the float valve 36 opens to replenish the supply.

As best shown in FIG. 3, the slinger collar 51 provides a highly efficient spray pattern as identified by the dashed line arrows B. These arrows are shown directing the fine mist spray against the entire area of the subcooler coils 30. In accordance with an important aspect of the present invention, a full length vertical panel 55 is provided in one corner of the coils 30. This panel 55 serves a very important function of intercepting a portion of the fine mist spray from the slinger collar 51 allowing this portion of the water to trickle down by gravity into overflow reservoir 56.

The water received in the overflow reservoir includes a higher concentration of dissolved minerals, as represented by reference indicia C'. The amount of spray hitting the panel 55 is represented by the angular space S. Thus, overflow cooling water C' is thus metered and constantly being discharged from the system. An overflow pipe 57 allows the reservoir 35 to remain at a constant level.

If desired, an adjustment can be provided for the panel 55 in order to adjust the metered amount of overflow cooling water C' that is discharged. This may take the form of a threaded fastener and slot combination connecting overlapping leaves to form the panel 55 (see FIG. 5). As the adjustment between the leaves is made, the size of the spray arc S and the amount of discharge will accordingly be adjusted in order to fit the particular requirements of preventing build-up of mineral deposits on the coil 30.

It has been discovered by experimentation that the desired ratio of the surface of the cooling coil 30 and the evaporative subcooler 10 to the surface of the intercepter panel is in the range of 42:1 to 14:1. Within this range, depending upon the hardness of the tap cooling water being fed to the system, and the proportion of condensate C that is mixed in reservoir 35, there is no appreciable build-up of mineral deposits on the cooling coil 30. Further, in this regard, by experimentation the preferred ratio of cooling coil area to intercepter panel area is found to be approximately 30:1, or approximately 10% of the water used is overflowed.

In summary, the advantageous results of providing the evaporative subcooler 10 as an integral part of a refrigeration circuit and the related features of the present invention can now be seen. A substantial increase in the cooling efficiency of the circuit is attributable to lowering of the liquid refrigerant temperature just prior to entry into the expansion valve/evaporator 23, 24. This efficiency is represented by a substantial enlargement of the diagram outline along the lefthand side of the pressure/enthalpy chart for CFC refrigerants. Additional efficiency is obtained by utilizing a three-stage refrigerant condensing and subcooling system by adding a counterflow heat exchanger adjacent the evaporative subcooler 10. Condensate/tap cooling water from the reservoir 35 is supplied to the evaporative subcooler 10 for spraying by a pump/slinger 50. An overflow reservoir 56 receives the constant and metered flow of water from the cooling water spray in order to reduce the concentration of mineral deposits. The preferred ratio of surface area between the cooling coil and the intercepter panel for metering the overflow is in the range of 42:1 to 14:1.

The foregoing description of a preferred embodiment of the invention has been presented for purposes of illustration and description. It is not intended to be exhaustive or to limit the invention to the precise form disclosed. Obvious modifications or variations are possible in light of the above teachings. The embodiment was chosen and described to provide the best illustration of the principles of the invention and its practical application to thereby enable one of ordinary skill in the art to utilize the invention in various embodiments and with various modifications as is suited to the particular use contemplated. All such modifications and variations are within the scope of the invention as determined by the appended claims when interpreted in accordance with breadth to which they are fairly, legally and equitably entitled.

We claim:

1. A refrigeration system or the like having a compressor, condenser, expansion means and an evaporator connected in series, the compressor providing compressed refrigerant gas to the condenser, the outlet of the condenser conducting liquid refrigerant back to the expansion means/evaporator, and an evaporative subcooler in said system connected downstream of the condenser so as not to act on the section of the system having superheated gas exiting said compressor, and upstream of said expansion means/evaporator to act by the evaporative process to reduce the temperature of the refrigerant liquid, whereby to provide a greater cooling effect of the refrigerant in the evaporator to increase the refrigeration system efficiency and substantially reduce the mineral deposits and prevent scale build-up on said subcooler.

2. The refrigeration system of claim 1, wherein is provided means for supplying cooling water to said evaporative subcooler in greater quantity than needed to subcool the refrigerant liquid and means for providing overflow of extra water.

3. The refrigeration system of claim 2, wherein said overflow means includes an intercepter panel positioned along the subcooler for receiving and diverting a portion of the cooling water, and an overflow reservoir for receiving the water from the intercepter panel and allowing overflow to reduce the concentration of mineral deposits in the cooling water.

4. The refrigeration system of claim 3, wherein said evaporative subcooler includes a cooling coil, the ratio of a cooling coil surface area in the evaporative subcooler to a surface area of the intercepter panel is in the range of 42:1 to 14:1 and means for adjusting the ratio.

5. The refrigeration system of claim 4, wherein the ratio of cooling coil surface area to intercepter panel surface area is approximately 30:1 and provides a ratio of the evaporation rate to the overflow rate of approximately 10:1.

6. The system of claim 1 wherein is further provided means for supplying cooling water to said evaporative subcooler, pump/slinger means for distributing the supply of cooling water in a fine spray over the cooling coils of the evaporative subcooler.

7. The system of claim 6 wherein said supplying means comprises a reservoir for supplying tap water to said evaporative subcooler and is further provided overflow means comprising a weir in a reservoir for releasing a predetermined amount of the tap water supply without contact with the cooling coils of said subcooler sufficient to reduce the concentration of mineral deposits.

8. The system of claim 7 wherein said overflow means is operative to release approximately 10% of the tap water supply;

whereby maximum efficiency of reduction of mineral deposits for the given tap water supply is attained.

9. The system of claim 1 wherein is further provided means for supplying cooling water to said subcooler, said supplying means including a water reservoir, said subcooler including a cooling coil mounted above the level of water in said reservoir.

* * * * *